United States Patent [19]

Long

[11] Patent Number: 4,469,372

[45] Date of Patent: Sep. 4, 1984

[54] ROLLABLE STOOL

[76] Inventor: Daniel C. Long, 14314 Hamilton, Riverview, Mich. 48192

[21] Appl. No.: 287,034

[22] Filed: Jul. 27, 1981

[51] Int. Cl.[3] ..... A61H 3/04; A47C 9/00

[52] U.S. Cl. ..... 297/5; 297/461; 297/440; 248/188.7

[58] Field of Search ..... 297/5, 241, 440, 461; 248/188.6, 188.7, 165, 158, 407

[56] References Cited

U.S. PATENT DOCUMENTS

| | | | |
|---|---|---|---|
| 764,695 | 7/1904 | White | 248/188.7 |
| 1,591,110 | 7/1926 | Willson | 248/165 |
| 2,295,281 | 9/1942 | Grunwald | 248/188.7 |
| 2,466,148 | 4/1949 | Birr | 248/188.7 |
| 2,508,932 | 5/1950 | Turner | 297/439 X |
| 2,582,767 | 1/1952 | Carey | 248/165 |

FOREIGN PATENT DOCUMENTS

| | | | |
|---|---|---|---|
| 75632 | 9/1949 | Norway | 248/188.7 |
| 248174 | 2/1948 | Switzerland | 248/407 |

*Primary Examiner*—Francis K. Zugel

*Attorney, Agent, or Firm*—Harness, Dickey & Pierce

[57] ABSTRACT

A light weight tripodal, rollable stool provided with low friction casters has a bicycle seat, seat support post, and height adjustment means rigidly supported by a front leg, and has two rear legs rigidly supporting the front leg. The stool supports a person seated thereon in a generally standing position. The front leg is shaped to allow the stool to be used in close proximity to work stations like kitchen counters or workbenches, while the rear legs and front leg are arranged so as to provide generous clearance for the legs of a person rolling about on the stool.

1 Claim, 4 Drawing Figures

ROLLABLE STOOL

BACKGROUND AND SUMMARY OF THE INVENTION

This invention relates to the field of unpowered, portable vehicles used for personal support, and more particularly to the field of light weight rollable stools.

As used hereinafter in the description and claims, the phrases generally erect standing person, generally standing person, and person in a generally standing position shall all have the same meaning, namely: a person having a generally vertical torso and generally straightly disposed legs which may be slightly bent at the hips, knees, or ankles, or slightly bent in any combination thereof. This definition is deemed to include, but not be limited to, a person in a slight crouch, a person standing with legs slightly or substantially apart, and a person whose legs extend predominantly downwardly while projecting slightly forwardly of said person, irrespective of whether the feet of said person are substantially together or apart.

At present, there is a need in personal residences, offices, hospitals, and factories for a light weight rollable stool which will substantially support a generally standing person seated or rolling about thereon, and which will provide generous clearance for the legs of such a person.

Persons needing such a stool include those who are unable to stand or move about for any length of time without substantial support. Persons who might well desire such a stool include: those who must presently work in a standing position, but could work while resting on a stool in a generally standing position provided the stool gave them mobility and did not unduly restrict their work range; and those who desire a very easily moved stool which cooperates with their own legs to provide them with greater stability than a conventional stool while they are resting on the stool in a generally standing position.

Other inventors have devised a variety of personal vehicles for a number of special purposes where the person seated thereon self-propelledly rolls about. These vehicles range from children's tricycles, to steerable vehicles for semi-ambulatory medical patients, to collapsible vehicles for invalids with hand-operated steering and brake means. As useful as these inventions are for their particular purposes, they do not meet the needs of a generally standing person who wishes to rest on a stool while performing some sort of task or useful work, and who also wishes to be simultaneously relatively mobile and unrestricted in his range of movement.

The basic object of this invention is to provide a rollable stool adapted for substantially supporting a generally standing person resting thereon and rolling about while remaining thereon.

Another object of this invention is to provide a rollable stool fulfilling the basic object of this invention that does not require the use of handlebars or other members that need to be manually grasped for support or balance.

Still another object of this invention is to provide a rollable stool fulfilling the basic objective which also enables a person resting thereon to position himself close enough to a kitchen counter, workbench, or other work area that has a generally vertically arranged face to comfortably perform many of the typical tasks found at such a work station.

Yet another object of this invention is to provide a rollable stool fulfilling the basic objective while presenting generous clearance for the movement of the legs of the person on the stool.

Other objects, features and advantages of the present invention will become apparent from the subsequent description and appended claims taken in conjunction with the accompanying drawings.

DESCRIPTION OF THE PREFERRED EMBODIMENT

Figure 1:
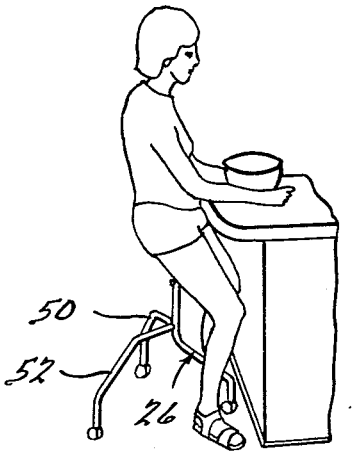
FIG. 1 is a side perspective view of a generally standing person resting on the rollable stool while working at a kitchen counter.

Referring to the drawings in detail, a seat means for substantially supporting the weight of a generally standing person, such as a bicycle seat 10, is located directly above and is connected to a seat support means for supporting the seat means from below, such as a vertically arranged post 12. The bicycle seat 10 has a metal frame 14 and a padded cushion 16. The post 12 has a substantially vertical axis 18.

An upper end segment 20 of the post 12 is partially disposed in a complementary opening 22 in the metal frame 14 of the seat. The opening is clamped firmly around the upper end segment of the post via a conventional fastener 24, such as a bolt and nut combination.

The present invention should preferably incorporate a bicycle seat having a conventional bicycle means for adjusting the pitch of the bicycle seat to provide for individualized seating comfort and seating stability. Such pitch adjustment means are well-known in the bicycle seat art and need not be repeated here. The present invention, although preferably incorporating a conventional bicycle seat, is not intended to be limited to such a seat means, since other seat arrangements could be utilized, including those having integral or separate seat back provisions.

The post 12 is located directly above, connected to, and supported by an upper end portion 28 of a first leg member, called a front leg 26, due to its orientation with respect to the bicycle seat 10. A lower end segment 30 of the post 12 is partially disposed in a complementary socket 32 of the front leg 26.

The front leg 26 is provided with a transverse hole 36 in the area of the socket 32. The post 12 is provided with a series of spaced transverse holes, exemplified by holes 38, 40, and 42, aligned to communicate with the transverse hole 36 in the front leg 26. The front leg 26 and lower end segment 30 of the post are rigidly and detachably coupled to one another via a conventional fastener 34, such as a bolt and nut combination, disposed in the hole in the front leg 36 and one of the communicating holes, such as hole 38, 40, or 42 in the post 12. The series of holes in the post, the hole 36 in the front leg, and the fastener 34 form a means for adjusting the height of the seat to facilitate use of the stool by persons of different heights. Other conventional or suitable means for adjusting seat height familiar to those in the bicycle art could also be used.

Figure 4:
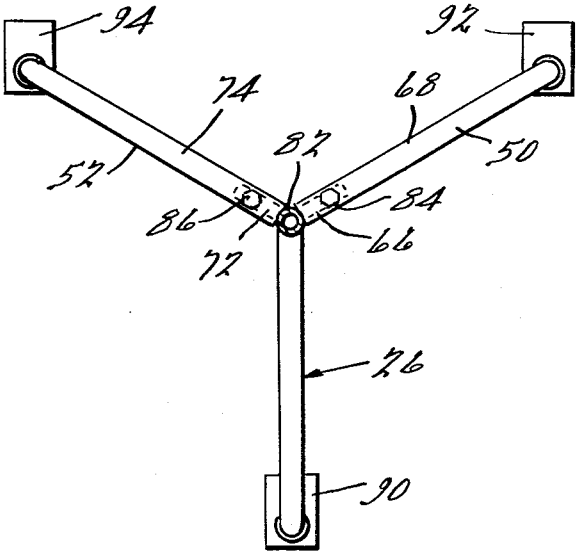
FIG. 4 is a fragmentary plan view of the rollable stool taken along line 4—4 of FIG. 2, illustrating the orientation and the displacement of its legs.
Figure 3:
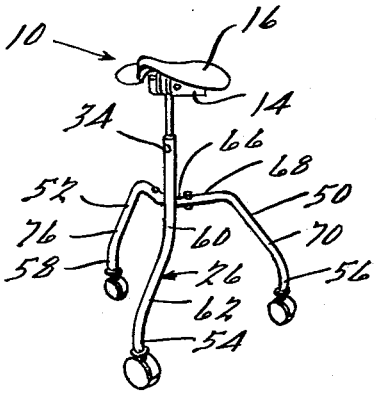
FIG. 3 is a front perspective view of the rollable stool.

The preferred embodiment of the invention has three leg members, the aforementioned first leg member and a pair of second leg members, called rear legs 50 and 52. The legs 26, 50 and 52 have lower end portions 54, 56 and 58 respectively, which are generally vertically arranged. As illustrated in FIGS. 3 and 4, the lower end portions 54, 56 and 58 are generally circumferentially and generally equiangularly disposed about the vertical axis 18 of the post 12 so as to provide stability for the stool in all horizontal directions.

Figure 2:
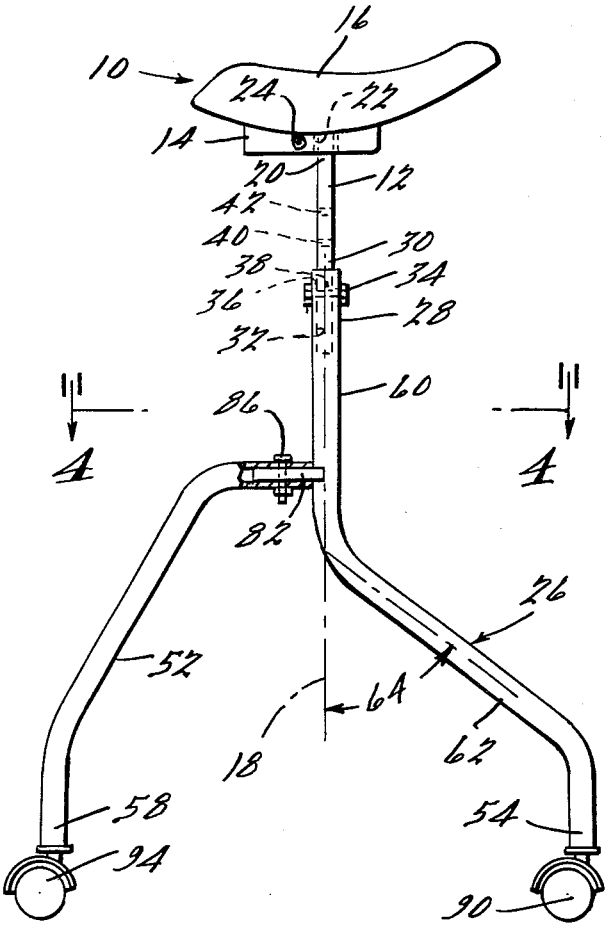
FIG. 2 is a side elevational view of the rollable stool with the bracket area of the stool shown in cross section.

The upper end portion 28 of the front leg 26 constitutes a generally vertically arranged first portion of the front leg, while the lower end portion 54 of the front leg constitutes a fourth portion of the front leg. Between these two upper and lower portions of the front leg are two more portions, as best shown in FIG. 2. These are a second portion 60, which extends generally vertically downwardly from the first portion 28, and a third portion 62, which extends downwardly at a predetermined first angle 64 from the second portion 60 to the lower end portion 54.

The rear legs 50 and 52 are identical in construction and shape to one another. Each rear leg has four portions: a first portion rigidly connected to the front leg, a second portion extending generally horizontally from the front leg, a third portion extending downwardly at a predetermined second angle from the second portion to the aforementioned lower end portion of the rear leg, which is the fourth portion of the rear leg. On rear leg 50 these four portions are numbered 66, 68, 70 and 56 respectively. On rear leg 52 they are numbered 72, 74, 76 and 58 respectively.

The legs 26, 50 and 52 and post 12 of the preferred embodiment are each constructed from a light weight high strength steel alloy tube in order to reduce the over-all weight of the stool. Those skilled in the art no doubt recognize that other conventional or suitable materials could also be used for the legs and post.

The first portion of each rear leg may be welded or otherwise conventionally or suitably rigidly connected to the front leg. The preferred embodiment employs a means for detachably as well as rigidly connecting the rear legs to the front leg in order to permit disassembly of the stool and to facilitate shipping the stool in compact form. This means is comprised of the following components and features. First, bifurcated bracket 82 is transversely and rigidly attached to the second portion 60 of the front leg 26. This bracket has a hole near each end of the bracket. Second, first portions 66 and 72 of the rear legs 50 and 52 are provided with sockets complimentary to and adapted for receiving the ends of the bracket disposed therein, and with transverse holes in the areas of the sockets communicating with the holes in the ends of the bracket. Third, removable pin means or fasteners 84 and 86, such as bolt and nut combinations, are inserted in the holes in the rear legs and in the holes of the bracket 82.

Obviously, the aforementioned means for rigidly and detachably connecting the rear legs 50 and 52 to the front leg 26 allows disassembly of the front leg from the rear legs by removal of the fasteners 84 and 86 and withdrawal of the ends of the bracket from the sockets of the first portions 66 and 72 of the rear legs. Reassembly is accomplished by reversing this procedure.

The preferred embodiment has a trio of rolling means 90, 92 and 94 associated with and connected to the lower end portions 54, 56 and 58 of the legs respectively which support the legs for rolling movement upon a generally horizontal support surface, such as a hard clean floor. The rolling means shown in the drawings are low friction ball bearing fully swivelable casters which facilitate rolling movement and rotating movement of the stool in any horizontal direction. Sockets are provided in the lower end portions of the legs for the complementary upper sections of the casters disposed therein.

The wheel portions of the casters are made of hard, tough non-skuff plastic in order to reduce rolling resistance and to help avoid marring the floors the stool is used on.

The aforementioned casters 90, 92 and 94, legs 26, 50 and 52 and post 12 of the preferred embodiment shown in the drawings coact to form a stable rollable base for the seat 10.

In the preferred embodiment, the aforementioned means for adjusting the seat height allows vertical height adjustments of the stool from about twenty-seven to about thirty-four inches, measured along the vertical axis 18 from the seat 10 to the floor. The lower end portions 54, 56 and 58 of the legs are displaced radially, horizontally outward from the vertical axis 18 of the post 12 about fifteen inches. The furcated bracket 82 is roughly eighteen inches above the floor. The first and second predetermined angles are roughly 50 degrees and 60 degrees respectively. The first portion of each rear leg is about two inches long and the second portion of each rear leg is about seven inches long.

Although the physical dimensions and spacings of the components in the preferred embodiment have described with unusual specificity, it is recognized that most lengths and angles and even the point of connection of the rear legs to the front leg or the front leg to the post could be altered somewhat without drastically effecting the efficacy of the instant invention.

It has been determined that the aforementioned size, spacing and orientation of the preferred embodiment is well adapted for substantially supporting a generally standing person resting on the seat. It has also been determined that said stool is well adapted for providing generous clearance for the legs of a generally standing person self-propelledly rolling about upon a generally horizontal support surface while resting on and substantially supported by the seat. In particular, the shape, location and spacing of the rear legs permits a person seated on the stool to move his legs substantially rearward, and even at times place his feet partially under the rear legs as he rolls about, without having the rear legs significantly impede the movement of his legs. Also, the front leg, which has a substantially lower profile than either of the rear legs, permits a person seated on the stool, or getting off or on the stool, to move either of his legs around or partially over the front leg of the stool without having the front leg seriously impair any necessary or desirable movement of the person's legs.

The stool is designed for substantially supporting the weight of a generally standing person. This characterization of the stool is employed because, although the stool can support the entire weight of a person seated thereon, the normal and intended mode of using the stool is for the user to place most of his weight on the seat and some of his weight on each of his legs. Generally, the user's legs will be and should be spread apart and in contact with the floor in order to assist in maintaining his balance while on the stool. With his feet so positioned, the user is better able to impart control and power over his arm and body movements while working on a task from the stool.

The shape and orientation of the front leg 26 taken in conjunction with the height of the seat 10 permit the stool to be used close enough to work stations, like kitchen counters and workbenches, that the person seated thereon can comfortably perform many tasks normally done by a standing persons at the work stations. Such work stations generally have vertically arranged surfaces, faces or obstructions which do not permit many other types of rollable personal vehicles to get close enough to allow the person seated thereon to perform these same tasks. By effectively eliminating the lap that a person seated on a conventional stool has, the preferred embodiment allows a person seated thereon to get closer to the work station, and gives that person a corresponding greater work range.

Another advantage of the preferred embodiment is that a person seated thereon can relatively effortlessly roll the stool sideways or in any other horizontal direction due to the fully swivelable ball bearing casters.

While it is apparent that the preferred embodiment of the invention disclosed is well calculated to fulfill the objects stated above, it will be appreciated that the invention is susceptible to modification, variation and change without departing from the proper scope or fair meaning of the subjoined claims.

What is claimed is:

1. A rollable stool for substantially supporting the weight of a person in a generally standing position resting thereon and self-propelledly rolling about thereon, comprising:

seat means for substantially supporting the weight a person in a generally standing position, said seat means situated above the rest of the stool;

seat support means for supporting said seat means from below, having and arranged along a substantially vertical axis;

a trio of leg members, each having a lower end portion, said lower end portions generally circumferentially and generally equiangularly disposed about said axis to provide stability for the stool in all horizontal directions, comprising a first leg member having a generally vertically arranged first portion defining an upper end portion of said first leg member attached to and supporting said seat support means, a second portion extending generally vertically downwardly at a predetermined first angle from said second portion to said lower end portion of said first leg member, and a pair of second leg members, each having a first portion regidly connected to said first leg member, a second portion extending generally horizontally from said first leg member, and a third portion extending downwardly at a predetermined second angle from said second portion to said lower end portion of said second leg member; and a trio of rolling means associated with and connected to said lower end portions of said leg members and supporting the same for rolling movement upon a generally horizontal support surface, said rolling means, leg members and seat support means coacting to form a stable rollable base for said seat means, said leg members and seat support means being sized and spaced to render the stool adapted for substantially supporting a generally standing person resting on said seat means, and adapted for providing generous clearance for the legs of a generally standing person self-propelledly rolling about upon a generally horizontal support surface while resting on and substantially support by said seat means, means for rigidly and detachable connecting the second leg members to the first leg member to permit disassembly of the stool and to facilitate shipping the stool in compact form, said last mentioned means comprising, a furcated bracket transversely and rigidly attached to the second portion of the first leg member having a hole near each end of the bracket:

second leg members having first portions provided with sockets adapted for receiving the ends of the bracket disposed therein, and transverse holes adjacent to the sockets, aligned with the holes in the bracket; and removable pin means for fixedly coupling the second leg members to the bracket inserted in the holes in said second leg members and in the holes of the bracket, thereby facilitating detachment of said second leg members from said first leg member by removal of the pin means and withdrawal of said ends of the bracket from the sockets of the second leg members.

* * * * *

UNITED STATES PATENT AND TRADEMARK OFFICE

CERTIFICATE OF CORRECTION

PATENT NO. : 4,469,372

DATED : September 4, 1984

INVENTOR(S) : Daniel C. Long

It is certified that error appears in the above-identified patent and that said Letters Patent is hereby corrected as shown below:

Column 4, line 28,
Delete "furcated" and substitute --bifurcated--.

Column 4, line 35,
After "have" insert --been--.

Column 5, line 11,
Delete "persons" and substitute --person--.

Column 5, line 36,
After "weight" insert --of--.

Column 6, line 6, claim 1,
Delete "regidly" and substitute --rigidly--.

Column 6, line 21, claim 1,
Delete "support" and substitute --supported--.

UNITED STATES PATENT AND TRADEMARK OFFICE

CERTIFICATE OF CORRECTION

PATENT NO. : 4,469,372

DATED : September 4, 1984

INVENTOR(S) : Daniel C. Long

It is certified that error appears in the above-identified patent and that said Letters Patent is hereby corrected as shown below:

Column 6, line 29, claim 1,

Delete "detachable" and substitute --detachably--.

Column 6, line 34, claim 1,

Delete "furcated" and substitute --bifurcated--.

Signed and Sealed this

*Twenty-sixth* Day of *March 1985*

[SEAL]

*Attest:*

DONALD J. QUIGG

*Attesting Officer* *Acting Commissioner of Patents and Trademarks*